United States Patent [19]

Nusser

[11] Patent Number: 4,527,884

[45] Date of Patent: Jul. 9, 1985

[54] DEVICE FOR INKING AN ELECTROSTATIC CHARGE IMAGE WITH TONER PARTICLES

[75] Inventor: Alban Nusser, Freising, Fed. Rep. of Germany

[73] Assignee: Siemens Aktiengesellschaft, Berlin & Munich, Fed. Rep. of Germany

[21] Appl. No.: 413,748

[22] Filed: Sep. 1, 1982

[30] Foreign Application Priority Data

Sep. 28, 1981 [DE] Fed. Rep. of Germany ..... 3138507

[51] Int. Cl.[3] ..... G03G 15/06; G03G 15/08; G03G 15/09; G03G 15/00

[52] U.S. Cl. ..... 355/3 DD; 355/3 SH; 118/647; 222/630; 430/103

[58] Field of Search ..... 355/3 DD, 3 SH; 222/630, DIG. 1, 146 HE; 430/103, 120, 100, 54, 121–126; 101/113, 114, DIG. 13; 118/655, 656, DIG. 1, 647, 654, 657; 346/153.1; 252/359 R, 359 A, 359 B

[56] References Cited

U.S. PATENT DOCUMENTS

| | | | |
|---|---|---|---|
| 2,942,573 | 6/1960 | Crumrine | 118/637 |
| 2,992,758 | 7/1961 | Hayford et al. | 222/630 |
| 3,094,248 | 6/1963 | Huber | 222/630 |
| 3,257,223 | 6/1966 | King | 355/3 DD X |
| 3,696,785 | 10/1972 | Andrus | 355/3 DD X |
| 3,828,670 | 8/1974 | Kennedy | 118/647 X |

OTHER PUBLICATIONS

"Elektrostatik und ihre Technische Anwendungen," S. Masuda, Zurich, 1973.

"Elektrodynamisches Verhalten der Aufgeladenen Aerosolteilchen in den Inhomogenen Wechsel-und Gleichfeldern," Zurich (1973), Masuda.

*Primary Examiner*—A. T. Grimley
*Assistant Examiner*—Terry Flower
*Attorney, Agent, or Firm*—Hill, Van Santen, Steadman & Simpson

[57] ABSTRACT

A device for inking an electrostatic charge image with toner particles in a xerographic unit is disposed adjacent to an information carrier on which the electrostatic charge image is carried so as to form a developing gap above the charge image. The device has a toner feed channel and a toner discharge channel which are surrounded by an excitation layer for electrostatic charging of the toner particles by triboelectricity. A plurality of multiphase electrodes are disposed adjacent to the device in the area of the feed and discharge channels, the electrodes being supplied with multiphase alternating voltage for generating a nonhomogeneous self-propagating electric field for delivery and withdrawal of the toner particles. A single phase alternating voltage is applied in the area of the developing gap for generating an electric field which presses the toner particles against the information carrier.

21 Claims, 10 Drawing Figures

DEVICE FOR INKING AN ELECTROSTATIC CHARGE IMAGE WITH TONER PARTICLES

BACKGROUND OF THE INVENTION

1. Field of the Invention

The present invention relates to xerographic devices, and in particular to a device for use in a xerographic unit for inking an electrostatic charge image carried on an information carrier with toner particles by means of aerosol formation.

2. Description of the Prior Art

In electrographic and electrophotographic xerographic devices an electrostatic charge image is generated on the surface of an image transfer element, the charge image being subsequently inked with toner particles in a developer station and the latent toner image which arises thereby is subsequently transferred to a carrier such as, for example, paper.

Printing devices are also known in which the electrostatic charge image is directly produced on the final carrier, for example on electrophotographic or dielectrical paper. For the purposes of the following discussion, that element of the xerographic unit which carries the electrostatic change image for the agglomeration of toner particles will be referred to as the information carrier.

A particle beam method by which particles are electrostatically charged by means of an excitation layer consisting of TEFLON (polytetrafluoroethylene) is described in the article "Elektrodynamisches Verhalten der Aufgeladenen Aerosolteilchen in den Inhomogenen Wechsel-und Gleichfeldern," Zurich (1973) by Senichi Masuda. As a result of the charging of the toner particles an aerosol cloud arises and is conveyed to a paper bed which is in the form of an electrode. The cloud is conveyed by an electric field of the traveling wave type. The aerosol cloud is converted into a particle beam in a band pass filter, the particles of the particle beam attracted by a rear plate electrode. The paper is disposed in front of the rear plate electrode. The particle beam is deflected in a desired direction onto the paper by deflection electrodes.

This known particle beam method, however, is not suited for a xerographic unit which utilizes an information carrier, which requires a uniform large-surface inking of the information carrier.

SUMMARY OF THE INVENTION

It is an object of the present invention to provide a device for inking an electrostatic charge image which achieves high image resolution and high inking speed and a uniform large-surface inking with a fault-free image background.

The above objects are inventively achieved in an apparatus which is disposed adjacent to the information carrier so as to form a developing gap in combination therewith, and which has a feed channel and a discharge channel for the toner particles which are surrounded by an excitation layer for electrostatically charging the toner particles by means of triboelectricity. A multiphase alternating voltage is applied to the particles in the area of the feed and discharge channels so as to generate a nonhomogeneous self-propagating electric field for delivery and withdrawal of the toner particles to and from the surface of the information carrier. A single phase alternating voltage is applied to the particles in the area of the developing gap for generating an electric field which presses the toner particles against the information carrier. This apparatus achieves a fast, uniform, large-surface inking with high resolution with a minimum of wear on the surface of the information carrier.

The apparatus disclosed and claimed herein has the advantage that the toner particles in the form an aerosol cloud, held together by the electric field produced by the nonhomogeneous alternating electric field, are transported in a non-linear trajectory and are concentrated at the surface of the information carrier as the particles move past the information carrier. An increase in the interaction of the toner particles with the surface of the information carrier is thus induced.

The toner particles are moved in the desired transport direction by means of an electric field. Because the field can be controlled rapidly and without significant time delay by means of a suitably selected dc voltage, the amplitude and the frequency of the traveling wave which transports the particles, the width of the development gap, the size and drift rate of the toner powder cloud and the trajectory of the toner particles can all be instantly adjusted essentially independently of one another. A good mixing and uniform distribution of the toner powder cloud is achieved as a result of the nonlinear trajectory of the toner particles. An electrode row disposed in the region of the developing gap simultaneously functions as a rear plate electrode for the intermediate carrier, thus enabling the homogeneous inking of larger surfaces.

DESCRIPTION OF THE PREFERRED EMBODIMENTS

Figure 1:
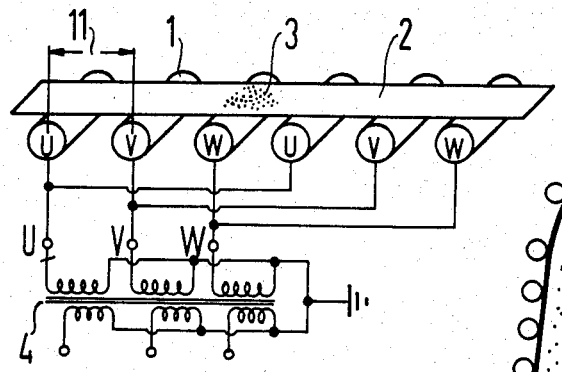
FIG 1 (PRIOR ART)
FIG. 1 is a schematic representation of a three-phase device for inking an electrostatic charge image with toner particles as is known in the art.

A conventional electric field generator of the contact type for use in xerographic devices is shown in FIG. 1 which has a row of parallel cylindrical electrodes 1 which are disposed on a surface insulated from one another and which are supplied with a three-phase alternating voltage from a three-phase voltage source 4. The electrodes are alternately connected to the phases U, V and W. Upon the application of a multi-phase alternating voltage, a nonhomogeneous self-propagating electric field of the traveling wave type is generated. The electrodes 1 have a diameter of approximately 6 mm and the spacing 11 between adjacent electrodes is approximately 10 mm. An insulating layer which is galvanically connected to the electrodes 1 on which toner particles 3 are situated is mounted above the electrodes 1. The toner particles are electrostatically charged and repelled by means of contact charging. The insulating layer will thus be referred to as an excitation layer 2. The excitation layer 2 may consist of polytetrafluoroethylene (TEFLON). When a single-phase alternating voltage is supplied to the electrodes 1, an electric field of the standing wave type is produced which functions solely as a blocking layer. The electric field of the traveling wave type functions simultaneously as a blocking means and a particle transport means.

Figure 2:
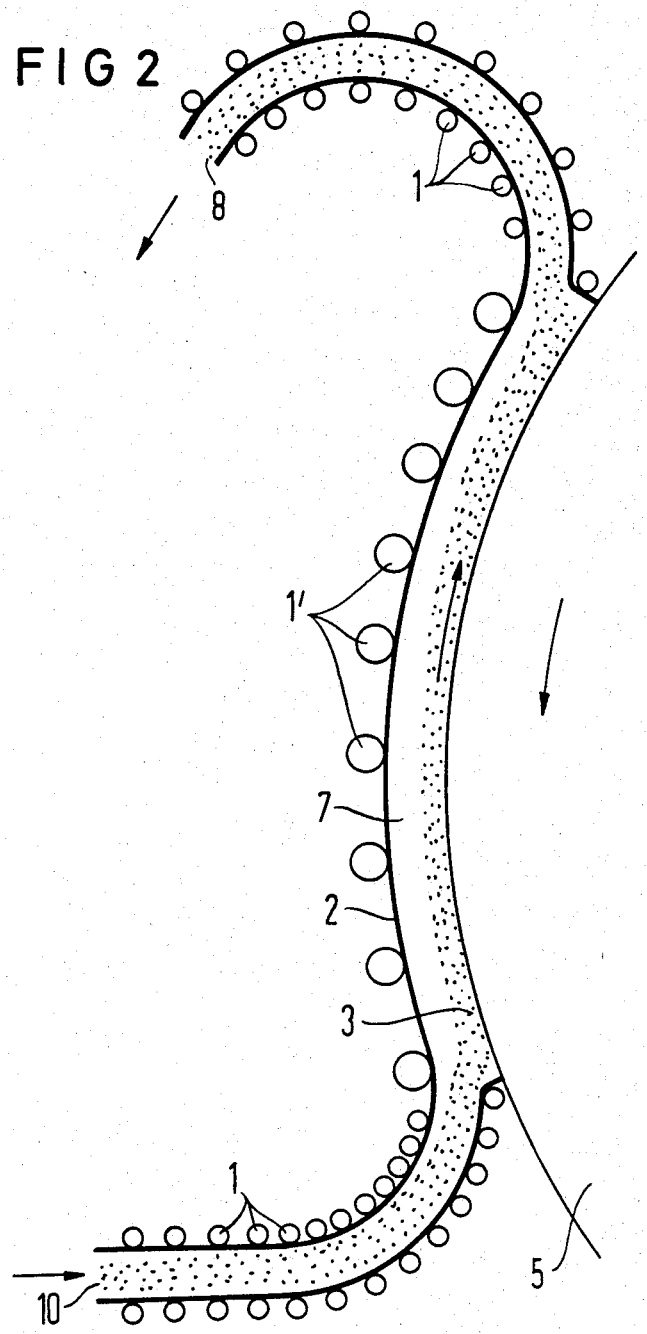
FIG. 2 is a device for inking an electrostatic charge image on an information carrier constructed in accordance with the principles of the present invention.

In the structure constructed in accordance with the principles of the present invention shown in FIG. 2, toner particles 3 are agglomerated in a developing gap 7 onto a cylindrical information carrier 5 which rotates in a direction opposite to the motion of the toner particles 3. The developing gap 7 is formed between electrodes 1', disposed behind the excitation layer 2 and parallel to the surface of the information carrier 5. A multi-phase operating voltage is supplied to the electrodes 1'. A feed channel 10 for supplying toner particles 3 from a reservoir (not illustrated) discharges into the developing gap 7. A discharge channel 8 conducts non-agglomerated toner particles 3 out of the developing gap 7. The developing gap 7, the feed channel 10, and the discharge channel 8 occupy substantially the entire width of the information carrier 5.

The feed channel 10 and the discharge channel 8 are formed by the electrodes 1 which are disposed parallel to one another and form a loop around the excitation layer 2, which completely surrounds the feed channel 10 and the discharge channel 8. The electrodes 1 and 1' are galvanically connected to the excitation layer 2 and are supplied with a multi-phase alternating voltage.

The toner particles 3 which are introduced from the reservoir into the supply channel 10 are charged by means of contact with one another and/or contact with the excitation layer 2. Charging of the particles 3 occurs predominantly by means of triboelectricity during impact against the excitation layer 2. The excitation layer 2 is therefore comprised of a material exhibiting triboelectric characteristics suitable for the desired polarity of the electric charge which is imparted to the toner particles 3. The electrically charged toner particles 3 are repelled and transported into the developing gap 7 by a self-propagating nonhomogeneous alternating field generated by the electrodes 1. In the developing gap 7, the particles 3 are concentrated at the surface of the information carrier 5 by the alternating field generated by the electrodes 1', which functions as a barrier layer, so that an increase in the amount of interaction contact of the toner particles 3 with the surface of the information carrier 5 is induced. By so doing, a fast and uniform inking of the electrostatic charge image on the information carrier 5 occurs. The electrodes 1' simultaneously serve as a rear plate electrode for the information carrier 5, thus enabling the homogeneous inking of larger surfaces. Non-agglomerating toner particles 3 are withdrawn via the discharge channel 8, which is designed substantially identical to the feed channel 10.

The charged toner particles 3 are transported in cycloidal or similar trajectories in the traveling wave alternating electric field. A uniform distribution and thorough mixing of the toner particles 3 is achieved by means of these non-linear trajectories. The trajectories of the toner particles 3 and the drift rate thereof are controlled by the electric fields generated by the electrodes 1 and 1' by a suitable selection of the dc voltage. The amplitude and frequency of the various modes of motion of the electric alternating field are thereby controlled. Inking of the information carrier 5 may occur as the carrier 5 rotates in the direction of motion of the toner particles 3, or when the information carrier 5 is standing still.

The development gap 7, the feed channel 10, and the discharge channel 8 can function in all spatial orientations, even against the force of gravity, by a suitable arrangement of the electrodes 1 and 1'.

Figure 3:
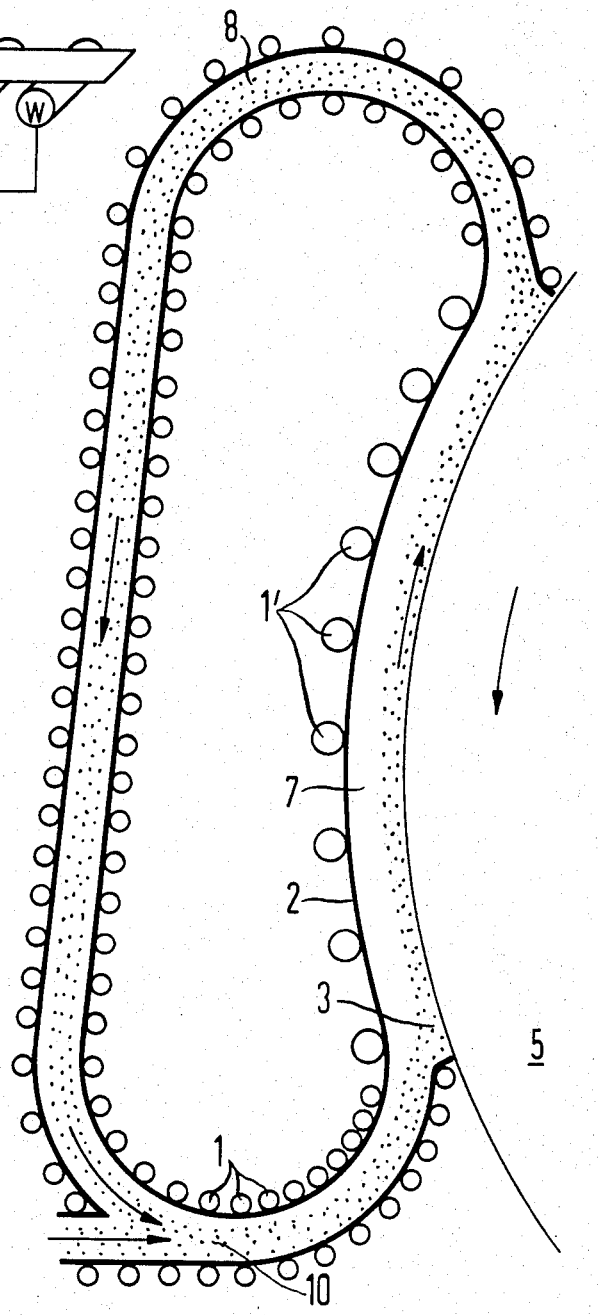
FIG. 3 is another embodiment of the device shown in FIG. 2.

A further development of the structure shown in FIG. 2 is shown in FIG. 3 wherein the discharge channel 8 and the feed channel 10 are connected in such a manner that the respective openings facing away from the developing gap 7 are joined. The feed channel 10 is still connected to a reservoir. In this manner, toner particles 3 which are not agglomerated on the information carrier 5 are conveyed in circulation for subsequent use.

Figure 4:
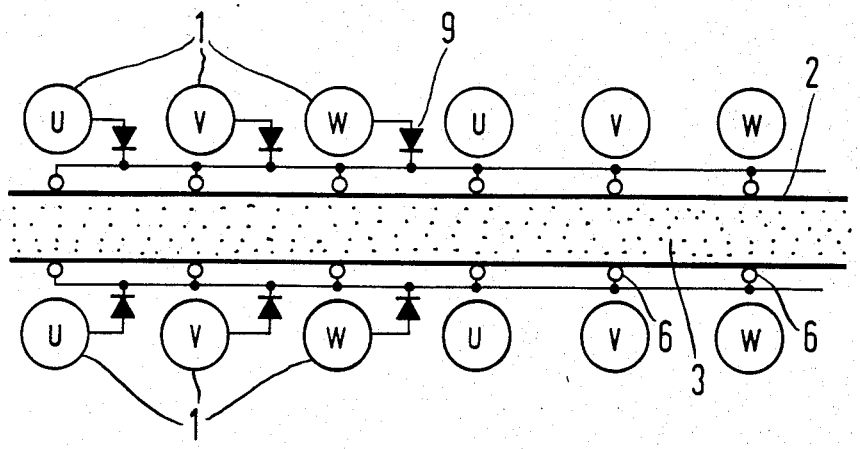
FIG. 4 is a detailed representation of a portion of the devices shown in FIGS. 2 and 3.

In an embodiment shown in FIG. 4, the excitation layer 2 is electrically connected to the electrodes 1 by means of a series of dc electrodes 6 connected in parallel which are directly connected to the excitation layer 2. The electrodes 6 are disposed parallel to the electrodes 1. One phase conductor U, V or W is connected to the dc electrode 6 through a rectifier 9. The material matching of the dc electrode 6 and the excitation layer 2 is selected such that charges proceed from the dc electrode 6 onto the excitation layer 2. By enhancing the excitation layer 2 with charges, the triboelectrical charging of the toner particles 3 is promoted, because the charges for the toner particles 3 are replaced. The electrodes 1 and the dc electrode 6 may also be in the form of double electrodes. The electrodes 1 and/or the dc electrode 6 may be secured to a carrier medium such as, for example, a plate bar.

Figure 5:
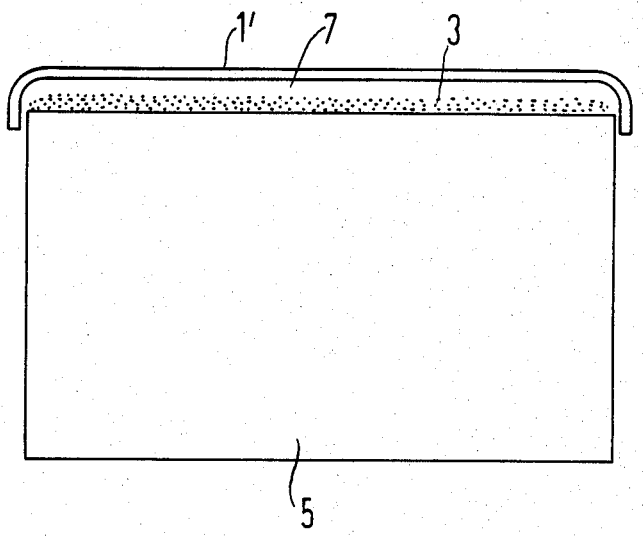
FIG. 5 is a cross-section seen through the developing gap in a first embodiment.

A cross-section through the developing gap 7 in one embodiment of the invention is shown in FIG. 5. The excitation layer 2 is omitted for clarity. The width of the developing gap 7 is selected such that the toner particles 3 are pressed against the surface of the information carrier 5 by the electrical field which is generated by the alternating voltage supplied to the electrodes 1'. The electrodes 1' and the excitation layer are conducted without contact a short lateral distance beyond the end faces of the information carrier 5 at the edge of the developing gap 7. The electric field generated by the electrodes 1' which exhibit a U-shape prevents the toner particles 3 from emerging from the developing gap 7 through the gap between the excitation layer 2 and the information carrier 5.

Figure 6:
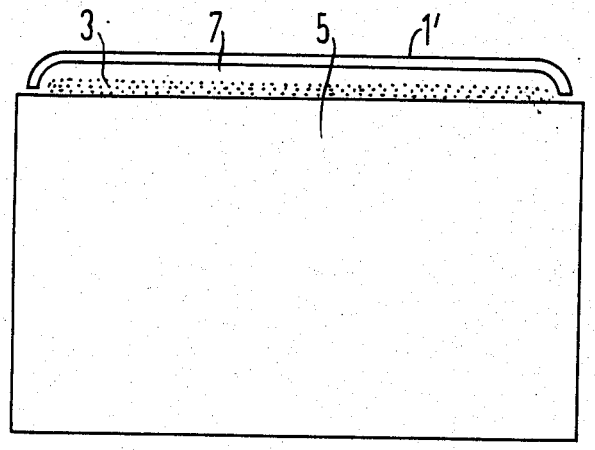
FIG. 6 is a cross-section seen through the developing gap in a second embodiment.

A cross-section through the developing gap 7 of a second embodiment of the invention is shown in FIG. 6. In this embodiment, the electrodes 1' are also U-shaped, however their ends are conducted without contact up to the edge of the cylinder surface of the information carrier 5. A sufficient seal is achieved by means of the electric field.

Figure 7:
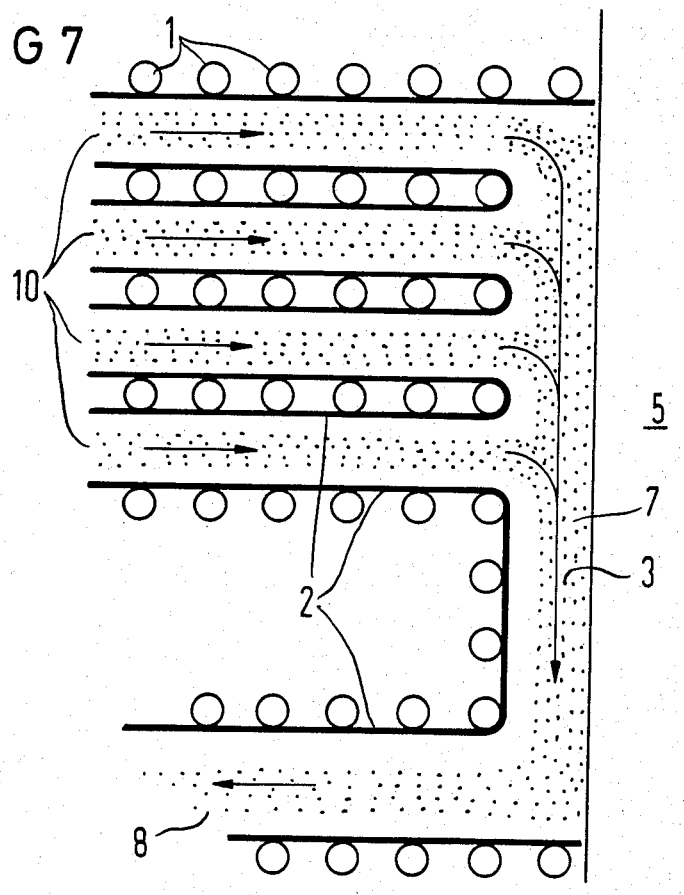
FIG. 7 is another embodiment of the device shown in FIG. 2.

Four parallel feed channels 10 are shown in FIG. 7 for introducing the toner particles 3 into the developing gap 7. A faster and more uniform inking of the information carrier 5 is thus achieved. Removal of excess toner particles 3 occurs via the discharge channel 8.

Transport of the electrically charged toner particles 3 may also be achieved by entrainment in a fluid flow such as, for example, an air flow which may be generated by a pressure differential generated by an air flow generator 17 so that no leakage losses occur.

Figure 8:
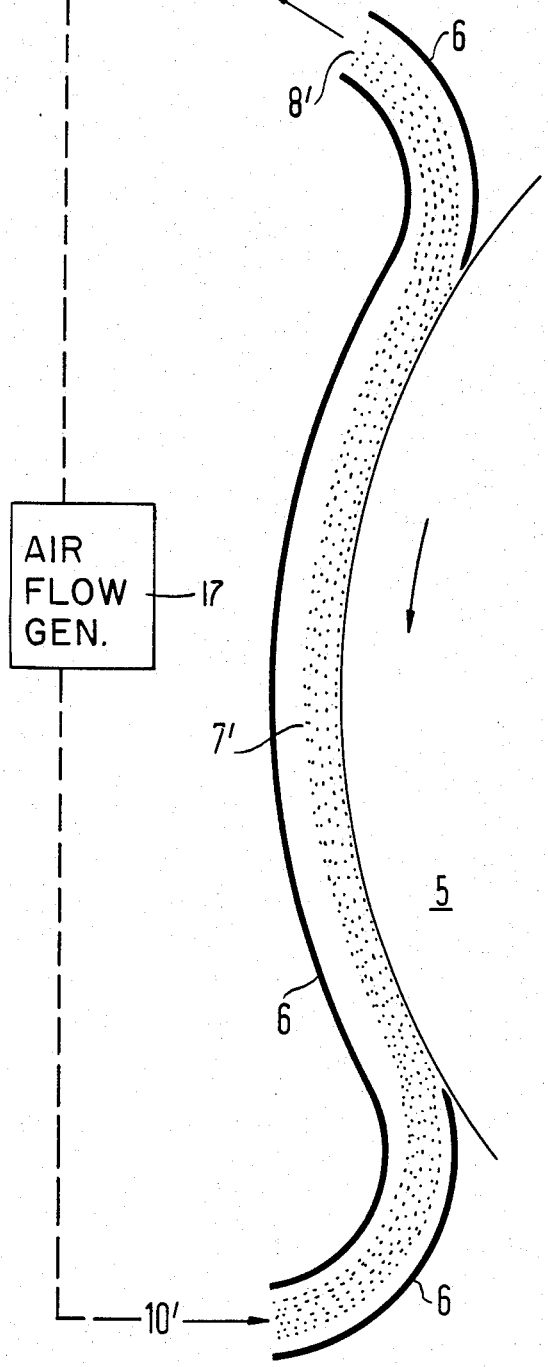
FIG. 8 is a longitudinal section seen through the developing gap of a device constructed in accordance with the principles of the present invention.

A gas-tight developing gap 7' is shown in FIG. 8. The side of the gap 7' disposed opposite the information carrier 5 is in the form of a dc electrode 6, and occupies substantially the entire width and length of the developing gap 7'. The dc electrode 6 is charged with the same electrical polarity as the toner particles 3 in order to press the particles 3 against the information carrier 5.

Figure 9:
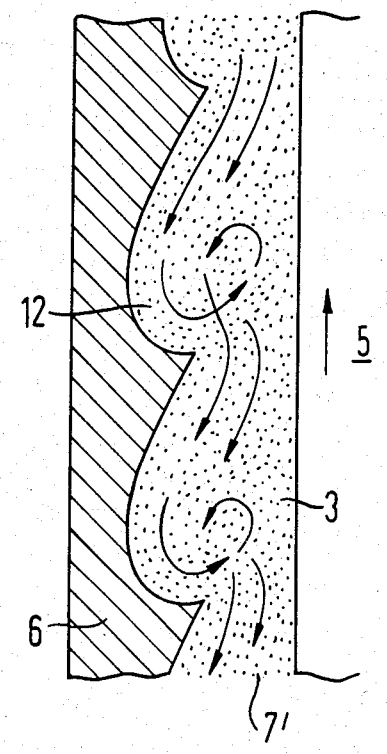
FIG. 9 is a detail of a first embodiment for the device shown in FIG. 8.

Eddys will arise in the gas flow as a result of the velocity differential of the air flow relative to the surface of the information carrier 5 and the dc electrode 6. Such eddys have the effect that toner particles 3 which are situated close to the dc electrode 6 are also brought to the surface of the information carrier 5. The walls of the developing gap 7' are thus provided with eddy pockets 12 in order to intensify the eddy formation. The embodiment shown in FIG. 9 shows a dc electrode 6 having a plurality of such eddy pockets 12. The eddy pockets 12 are in the form of recesses in the dc electrode 6 which agitate the gas stream being conducted past the pockets 12.

The surfaces of the channels and the front limitation of the developing gap 7' may be vibrated by a suitable vibrating means 16 so that the toner particles 3 will not deposit on the limiting walls. Such vibrations may, for example, be generated by an ultrasonic device.

The gas molecules in the gas flow, moreover, may also be vibrated to such a degree that the aerosol density is uniformly distributed. Such vibrations can also be achieved with ultrasonic devices.

Figure 10:
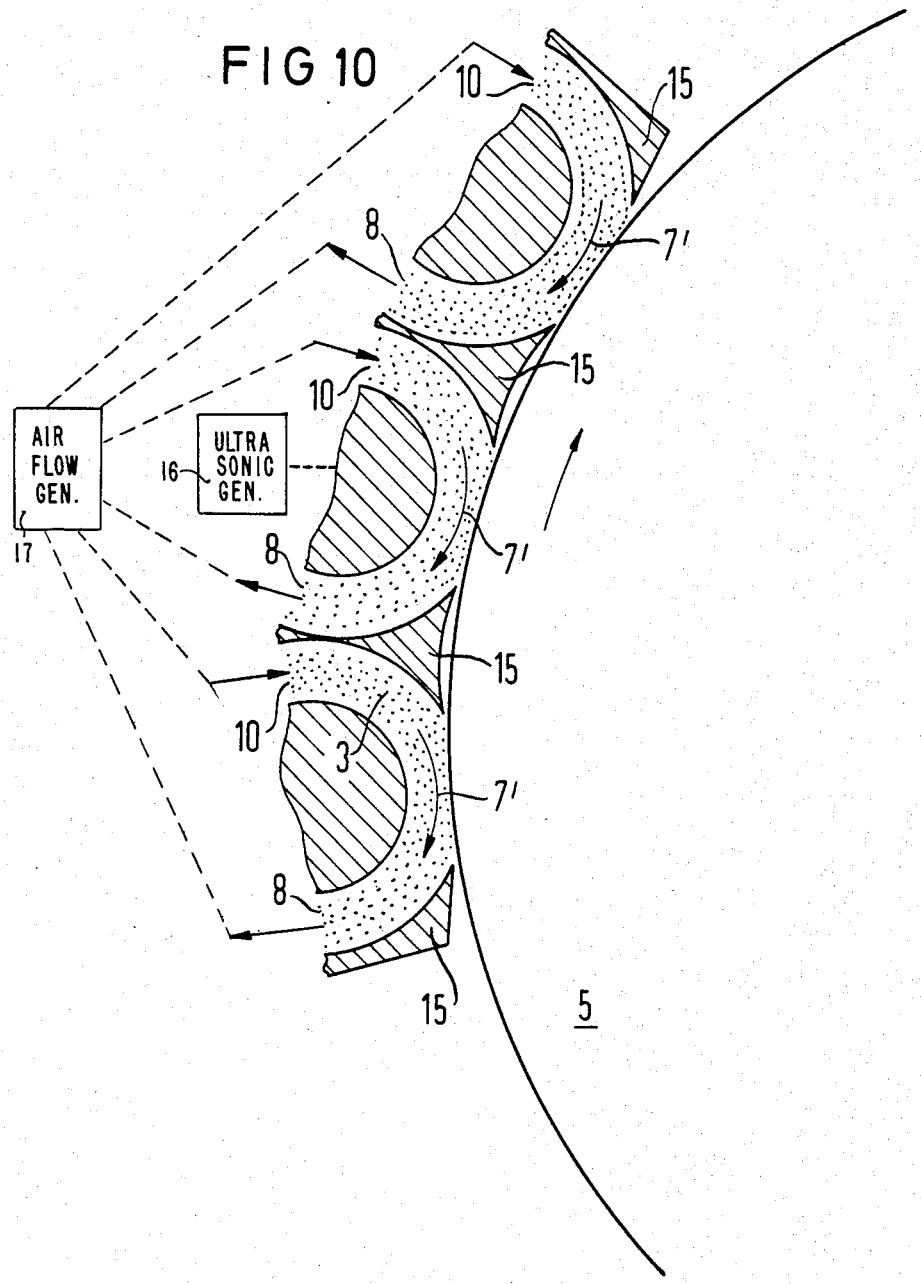
FIG. 10 is a detail of a second embodiment of the device shown in FIG. 8.

Three developing gaps 7' which are each connected to an associated feed channel 10 and a discharge channel 8 are shown in FIG. 10 disposed adjacent to the information carrier 5. The toner particles 3 are introduced into the developing gap 7' with the assistance of a gas flow from the air flow generator 17. Guidance plates 15 are provided along the entire width of the developing gaps 7' between the feed channels 10 and the discharge channels 8 which are concave and guide the toner particles 3 toward the information carrier 5, or away therefrom, in a pronounced curvature. The radii of the concave guidance plates 15 are dimensioned such that a channel with an approximately circular cross-section is formed between the transition of the feed channel 10 into the developing gap 7' and the transition from the developing gap 7' into the discharge channel 8. As a result of centrifugal force, the toner particles 3 which are carried in the circular channel are pressed against the surface of the information carrier 5. By connecting a plurality of such channels in series, a significantly larger amount of toner particles 3 can be brought against the surface of the information carrier 5, thereby improving the quickness and uniformity of the inking process.

Although modifications and changes may be suggested by those skilled in the art it is the intention of the inventor to embody within the patent warranted hereon all changes and modifications as reasonably and properly come within the scope of his contribution to the art.

I claim as my invention:

1. A device for inking an electrostatic charge image on a moving information carrier with electrically charged toner particles by means of aerosol formation, comprising at least one feed channel, at least one discharge channel, and at least one developing gap for receiving at least a portion of said formation carrier disposed therein and said gap being in communication with said feed channel and said discharge channel, said feed channel, developing gap and discharge channel having an excitation layer having a series of electrodes, means for supplying said electrodes with an alternating voltage for generating a nonhomogeneous electrical alternating field in the developing gap, in the feed channel, and in the discharge channel for transferring said toner particles in the form of a toner powder cloud through said feed channel, said developing gap, and said discharge channel in a direction opposite to movement of said information carrier.

2. A device as claimed in claim 1 wherein said alternating voltage is a multi-phase alternating voltage for generating an electrical field of the traveling wave type.

3. A device as claimed in claim 1 said developing gap has a width such that the electrically charged toner particles of a toner powder cloud held together by the electrical field are pressed against the surface of the information carrier in said developing gap and are transported past same.

4. A device as claimed in claim 1 wherein said excitation layer is electrically conductively connected to the electrodes.

5. A device as claimed in claim 1 wherein said electrodes are further supplied with a dc voltage superimposed on the alternating voltage.

6. A device as claimed in claim 5 wherein the toner particles of the toner powder cloud have respective trajectories therein and wherein the toner powder cloud moves through the electrical fields of the electrodes with a drift rate, said trajectories and said drift rate being variable and controllable by means of a corresponding selection of the dc potential, of the amplitude and of the frequency and of the type of the modes of the electrical alternating field.

7. A device as claimed in claim 1 wherein the electrodes allocated to the developing gap are disposed opposite said information character for functioning in combination as a back plate electrode for said information carrier for large-surface inking thereof.

8. A device as claimed in claim 1 further comprising a series of dc electrodes disposed between the excitation layer and said series of electrodes supplies with alternating voltage.

9. A device as claimed in claim 8 wherein only the series of dc electrodes are electrically connected to the excitation layer.

10. A device as claimed in claim 8 wherein said series of electrodes supplied with alternating voltage is connected to the series of dc electrodes through a plurality of rectifiers each connected to an electrode in said series of electrodes supplied with alternating voltage and connected between two electrodes in said series of dc electrodes.

11. A device as claimed in claim 8, wherein at least said series of electrodes supplied with alternating voltage is connected to a carrier medium.

12. A device as claimed in claim 8 wherein at least said feed channel has interior surfaces defined by said series of dc electrodes.

13. A device as claimed in claim 8 wherein at least said series of dc electrodes is connected to a carrier medium.

14. A device as claimed in claim 8 wherein both said series of electrodes supplied with alternating voltage and said series of dc electrodes are connected to a carrier medium.

15. A device as claimed in claim 1 wherein the electrodes are laterally disposed without contact over the information carrier in the developing gap.

16. A device as claimed in claim 1 wherein the electrodes are disposed without contact up to the surface of the information carrier in the developing gap.

17. A device as claimed in claim 1 wherein at least said developing gap has a surface spaced from said information carrier received therein having a plurality of projections extending toward said information carrier functioning as an excitation layer of the contact type for guiding said toner particles past said information carrier.

18. A device as claimed in claim 17 further comprising a means for vibrating said surface of the developing gap in order to prevent a deposit of toner particles thereon.

19. A device as claimed in claim 18 wherein said means for vibrating is an ultrasonic generator for inducing ultrasonic oscillations in said surface.

20. A device as claimed in claim 1 wherein said feed channel, said developing gap and said discharge channel form a continuous loop surroundings said excitation layer.

21. A device for inking an electrostatic charge image on an information carrier with electrically charged toner particles by means of aerosol formation, comprising at least one feed channel, at least one discharge channel, and at least one developing gap having at least a portion of said information carrier disposed therein and communicating with said feed channel and said discharge channel, and a means for generating an air flow for transporting said toner particles through said feed channel, said developing gap, and said discharge channel.

* * * * *